US007631976B2

(12) United States Patent
Rennick

(10) Patent No.: US 7,631,976 B2
(45) Date of Patent: Dec. 15, 2009

(54) REFLECTIVE ACCESSORIES

(76) Inventor: Vikki Rennick, 4039 N. Overlook Ter., Portland, OR (US) 97227

( * ) Notice: Subject to any disclaimer, the term of this patent is extended or adjusted under 35 U.S.C. 154(b) by 325 days.

(21) Appl. No.: 11/757,908

(22) Filed: Jun. 4, 2007

(65) Prior Publication Data

US 2008/0297900 A1 Dec. 4, 2008

(51) Int. Cl.
*G02B 5/12* (2006.01)

(52) U.S. Cl. ..... 359/515

(58) Field of Classification Search ..... 359/515, 359/516

See application file for complete search history.

(56) References Cited

U.S. PATENT DOCUMENTS

| | | | | |
|---|---|---|---|---|
| 2,078,103 | A | 4/1937 | Simmons | |
| 2,123,478 | A | 7/1938 | Smith | |
| 2,332,948 | A | 10/1943 | Stubbe | |
| 2,502,535 | A | 4/1950 | Richards | |
| 2,656,763 | A | 10/1953 | Frost | |
| 3,038,381 | A | 6/1962 | Jones | |
| 3,950,076 | A | 4/1976 | Carlson | |
| 4,443,056 | A | 4/1984 | Sullivan | |
| 4,517,685 | A | 5/1985 | Lesley | |
| 4,601,538 | A | 7/1986 | Valkenburg | |
| 5,169,702 | A | 12/1992 | Schell | |
| 5,193,026 | A | 3/1993 | Purvis et al. | |
| D388,725 | S | 1/1998 | Estrada | |
| 6,652,106 | B2 | 11/2003 | Sloot | |
| 7,032,338 | B2 * | 4/2006 | Sloot | 359/523 |
| 7,048,391 | B2 | 5/2006 | Greves | |
| 2002/0181104 | A1 | 12/2002 | Gonzales | |

OTHER PUBLICATIONS

Limb Lights, Model No. 00795, by Hunter's Specialties.
Dual Color Mag Limb Lights, Model No. 00715, by Hunter's Specialties.
Hunter's Specialties Trail Marker Tape, Model No. 00790.
Web pages describing Twist-Ems Ties, from www.twistems.com, as viewed on Jun. 4, 2007.

* cited by examiner

*Primary Examiner*—Euncha P Cherry
(74) *Attorney, Agent, or Firm*—Dascenzo Intellectual Property Law, P.C.

(57) ABSTRACT

Reflective accessories for increasing the visibility of persons engaged in night-time (or other low-light) activities. Reflective accessories include a mechanism configured for attachment of the accessory to an object associated with the person engaging in a low-light activity by looping the accessory around at least a portion of the object and twisting the mechanism about itself to thereby secure the accessory to the object, and a flexible body supported by the mechanism and having an outer surface with a portion configured to reflect light to a degree that the portion is generally more visible than the object to which the accessory is attached when a light source is directed at the accessory and the object.

27 Claims, 3 Drawing Sheets

REFLECTIVE ACCESSORIES

BACKGROUND

The present disclosure is directed to reflective accessories, and more particularly to accessories for increasing the visibility of persons engaged in low-light environment activities.

SUMMARY

Reflective accessories according to the present disclosure may be used by persons engaging in night-time (or other low-light) activities to increase the visibility of the persons and to thereby increase the likelihood they will be seen by others (e.g., by operators of automobiles). An example of a reflective accessory according to the present disclosure includes a mechanism configured for attachment of the accessory to an object associated with the person engaging in a low-light activity by looping the accessory around at least a portion of the object and twisting the mechanism about itself to thereby secure the accessory to the object. The accessory may also include a flexible body supported by the mechanism and having an outer surface having a portion configured to reflect light to a degree that the portion is generally more visible than the object to which the accessory is attached when a light source is directed at the accessory and the object.

DETAILED DESCRIPTION

Figure 1:
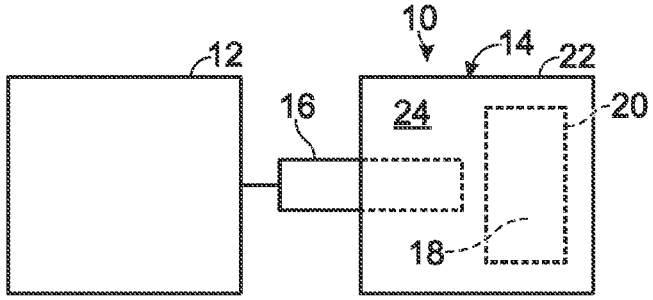
FIG. 1 is a schematic diagram of an accessory according to the present disclosure, the accessory shown coupled to an object.

Reflective accessories 10 according to the present disclosure are schematically illustrated in FIG. 1. Accessories 10 may be used by a person engaging in night-time (or other low-light) activities to provide increased visibility of the person and thereby increase the likelihood the person will be seen by others (e.g., by operators of automobiles). Accessories 10 may therefore be described as accessories for providing a degree, or level, of increased visibility of a person than otherwise if the person were not using one or more accessories 10. Examples of activities that accessories 10 may be particularly useful for include, but are not limited to, walking, jogging, running, hiking, cycling, etc. at nighttime or in other low-light environments. Some embodiments of accessory 10 may be referred to as reflectors. Some embodiments of accessory 10 may be referred to as safety devices.

As schematically illustrated in FIG. 1, accessories 10 are configured to be coupled, or attached, to an object 12. Object 12 may be any object generally associated with a person wishing to be seen by others. Nonexclusive examples of objects 12 include, but are not limited to, body parts (e.g., ankles, wrists, etc.), articles of clothing, belt loops, shoe laces, backpacks, purses, bicycles, strollers, etc.

Accessories 10 include a body 14 and a mechanism 16 for attaching an accessory 10 to an object 12. As schematically illustrated, mechanism 16 is coupled to body 14. Additionally or alternatively, body 14 may be described as being supported by mechanism 16. Similarly, mechanism 16 may be described as being supported by body 14. In some embodiments, as illustrated in FIG. 1, mechanism 16 may be only partially supported by body 14. Stated differently, mechanism 16 may be partially housed within body 14. Alternatively, mechanism 16 may be fully housed within body 14. In some embodiments, mechanism 16 may be at least partially housed within body 14. In some embodiments, body 14 may be described as a sheath that houses at least a portion of mechanism 16.

As mentioned, accessories 10 provide a degree of visibility that increases the likelihood a user of an accessory will be seen by others. Accordingly, body 14 has properties 18 that generally provide an increased level of visibility of at least a portion 20 of body 14. For example, properties 18 may include the color of portion 20. Bright colors, such as, but not limited to, yellow, orange, and/or fluorescent colors may be particularly suited for providing an increased level of visibility. Other colors are equally within the scope of the present disclosure.

Additionally or alternatively, properties 18 may include the degree of reflection that body 14 provides. For example, portion 20 of body 14 may be highly reflective so that portion 20 is illuminated when a light source is directed thereon. In some embodiments, portion 20 may be described as retroreflective (i.e., it reflects light back toward the light source, regardless of the angle of incidence on portion 20). Examples of retroreflective materials that may be used for portion 20 include, but are not limited to, products manufactured by 3M under the SCOTCHLITE® brand and products manufactured by JRC REFLEX.

In some embodiments, as schematically illustrated in FIG. 1, portion 20 may comprise only a portion of the outside surface of body 14. In such embodiments, body 14 may include a base, or substrate, 22 having an outside surface 24 to which portion 20 is attached. A non-exclusive example of a suitable fabric from which substrate 22, or at least a portion thereof, may be constructed includes, but is not limited to, nylon. Portion 20 may be attached to substrate 22 by any suitable means, including, but not limited to, stitching and/or adhesives. In other embodiments, portion 20 may comprise the entire body or at least the entire outside surface of body 14. Stated differently, body 14 and/or substrate 22 may be constructed of material(s) having properties 18, and thereby not requiring the addition of a separate portion having properties 18 attached thereto. Additionally or alternatively, portion 20 may be non-contiguous. That is, body portion 14 may include a plurality of portions 20 that have one or more properties 18 and that are attached to and/or form part of base 22.

A non-exclusive source for providing at least a portion of the material or materials used in the construction of accessories according to the present disclosure includes, but is not limited to, portions of used safety vests. Examples of safety vests include those typically used by municipalities or companies with workers engaged in activities where safety and therefore visibility of the workers are important (e.g., those worn by road-side crews, utility workers, surveyors, etc.). Typical safety vests are constructed of bright colors and often have reflective, and sometimes retroreflective, portions.

Figure 2:
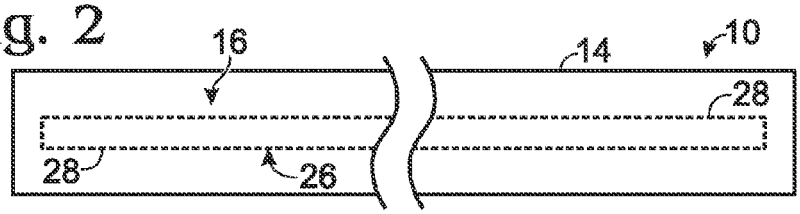
FIG. 2 is a schematic plan view of an accessory according to the present disclosure.
Figure 3:
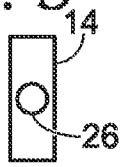
FIG. 3 is a schematic cross-sectional view of the accessory of FIG. 2.

A non-exclusive example of an accessory 10 is schematically illustrated in FIGS. 2 and 3. As shown, body 14 may (though is not required to) be generally rectangular in shape having a width less than its length. Accordingly, body 14 may be configured for being looped lengthwise around at least a portion of an object for attachment thereto. Non-exclusive examples of ranges of suitable of widths for at least a portion of body 14 include, but are not limited to, approximately ⅜-½, ⅜-¾, ⅜-1, ⅜-2, ½-¾, ½-1, and ½-2 inches. Non-exclusive examples of ranges of suitable lengths of body 14 include, but are not limited to, 3-6, 3-9, 3-12, 5-8, 5-11, and 5-14 inches. Other widths and lengths are equally within the scope of the present disclosure including widths and lengths greater than and less than the enumerated ranges disclosed herein. Design considerations that may factor into a selection of a suitable width and/or length include the particular application for which an accessory is to be used, the size of object to which an accessory is to be attached, the degree of desired visibility of an accessory, the material from which various components of an accessory are to be constructed, etc.

Figure 4:
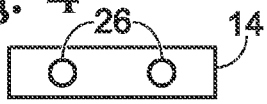
FIG. 4 is a schematic cross-sectional view of another embodiment of an accessory according to the present disclosure.
Figure 5:
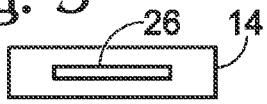
FIG. 5 is a schematic cross-sectional view of yet another embodiment of an accessory according to the present disclosure.
Figure 6:
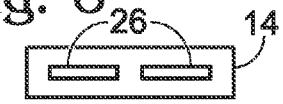
FIG. 6 is a schematic cross-sectional view of yet another embodiment of an accessory according to the present disclosure.

The example illustrated in FIGS. 2 and 3 includes a mechanism 16 in the form of a bendable core 26 housed within body 14. Accordingly, as described in more detail below, mechanism 16 may be twisted about itself to secure accessory 10 to an object. In some embodiments, an accessory 10 may include a single core 26, as illustrated in FIGS. 3 and 5. In other embodiments, an accessory 10 may include more than one core 26, as illustrated in FIGS. 4 and 6. Any suitable number of cores 26 may be incorporated into accessories according to the present disclosure. Though in FIGS. 2-6, core(s) 26 are illustrated as being generally centered, and/or evenly spaced within body 14, other configurations are equally within the scope of the present disclosure. That is, one or more cores 26 may be positioned generally toward one side of body 14. Additionally or alternatively, core(s) 26 are not required to be formed in a generally straight line through body 14.

Figure 7:
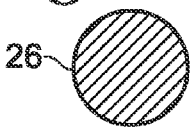
FIG. 7 is a cross-sectional view of an inner portion of an accessory according to the present disclosure.

Core(s) 26 may be made of any suitable material such as, but not limited to, metal having properties configured to permit repeated twisting and untwisting of core end portions 28 about each other. For example, as illustrated in FIGS. 3, 4, and 7, core(s) 26 may be metal wire with a generally circular cross-section. Alternatively, as illustrated in FIGS. 5 and 6, core(s) 26 may have a generally rectangular cross-section. Other configurations of core(s) 26 are equally within the scope of the present disclosure.

Figure 8:
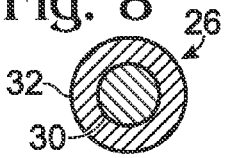
FIG. 8 is a cross-sectional view of an inner portion of another embodiment of an accessory according to the present disclosure.

Some embodiments of accessory 10 may include a core 26 having an inner metal wire 30 with an external non-metal sheath, or coating, 32, as illustrated in FIG. 8. For example, sheath 32 may be made of plastic, rubber, vinyl, or other flexible material. Such configurations of core 26 may provide properties particularly suited for repeated twisting and untwisting over time without breaking. A non-exclusive example of wire that may be suitable as core 26 is vinyl-coated braided picture frame hanging wire.

Figure 9:
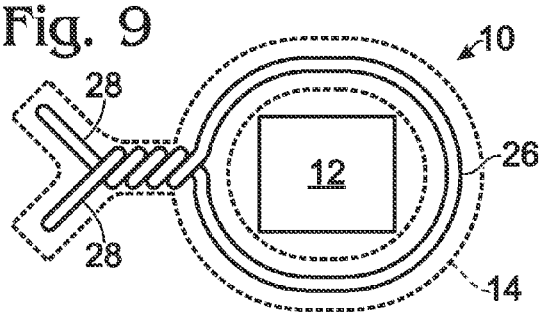
FIG. 9 is a plan view of an inner portion of an accessory according to the present disclosure shown twisted about itself and an outer portion of the accessory shown schematically about the inner portion, the accessory shown secured about an object.

FIG. 9 illustrates a single core 26 as it may be used to attach an accessory 10 to an object 12. Body 14 of accessory 10 is schematically illustrated in dashed lines. As illustrated, accessory 10, including core 26, may be looped around an object 12, and the ends 28 of core 26 may be twisted about each other, thereby securing the accessory to an object. Additionally or alternatively, ends 28 of core 26 may be tied to each other in order to secure accessory 10 to object 12.

Figure 10:
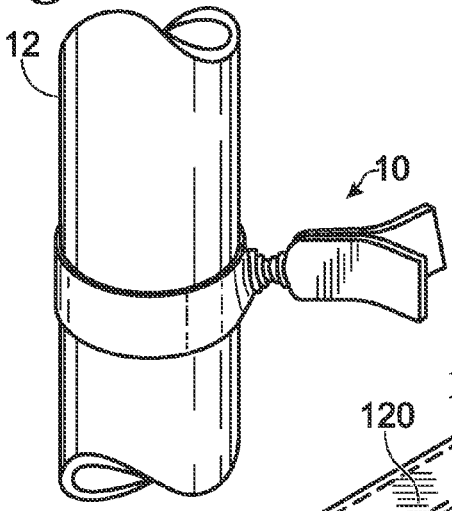
FIG. 10 is an isometric view of an accessory according to the present disclosure shown attached to an object.

FIG. 10 illustrates a non-exclusive example of an accessory 10 attached to an object 12.

Figure 11:
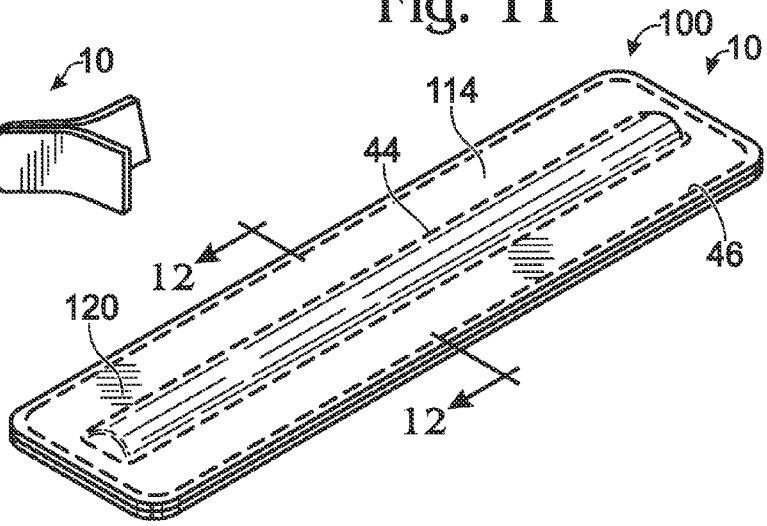
FIG. 11 is an isometric view of an accessory according to the present disclosure.
Figure 12:
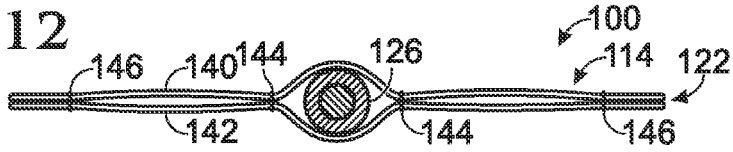
FIG. 12 is a cross-sectional view of the accessory of FIG. 11 accessory according to the present disclosure.

FIGS. 11 and 12 illustrate a non-exclusive example 100 of an accessory according to the present disclosure. As illustrated, accessory 100 includes a core 126 housed within a body 114. Body 114 includes a base 122 formed from two layers of material 140, 142 having retroreflective properties on at least the outer facing surfaces thereof. For example, as mentioned, layers 140, 142 may be constructed using SCOTCHLITE® brand retroreflective material. Additionally or alternatively, only one of layers 140, 142 may be reflective and/or retroreflective. Layers 140, 142 surround a core 126, and stitching 144 secures layers 140, 142 of base 122 about the periphery of core 126. Additional stitching 146 further secures layers 140, 142 together along their edges. As mentioned, accessories according to the present disclosure are not limited to being assembled using stitching. For example, layers 140, 142 may be bonded together using an adhesive to form body 114.

Figure 13:
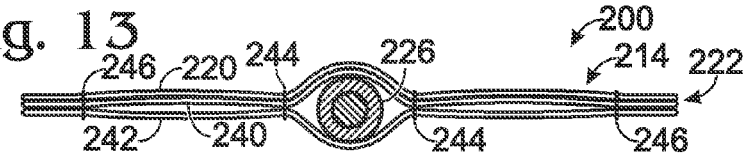
FIG. 13 is a cross-sectional view of another embodiment of an accessory according to the present disclosure.

Another non-exclusive example 200 of an accessory according to the present disclosure is illustrated in cross-section in FIG. 13. As illustrated, accessory 200 includes a core 226 housed within a body 214. Body 214 includes a base 222 and a reflective portion 220 in the form of a strip of retroreflective material, or other material having properties 18. Base 222 includes a first layer 240 and a second layer 242 that surround a core 226. As mentioned, a non-exclusive example of suitable material for base 222 includes nylon. Stitching 244 secures the first and second layers 240, 242 of base 222 about the periphery of core 226, and further secures reflective portion 220 to base 222. Stitching 246 further secures reflective portion 220 and first and second layers 240, 242 together. Though illustrated as including a reflective portion attached to one layer of base 222, it is equally within the scope of the present disclosure that an additional reflective portion may be attached to the other layer as well.

Figure 14:
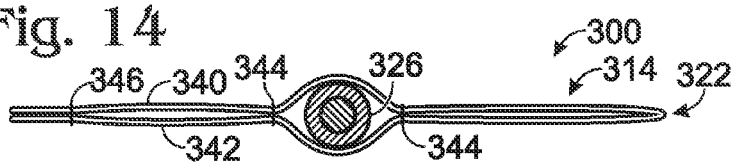
FIG. 14 is a cross-sectional view of yet another embodiment of an accessory according to the present disclosure.

Another non-exclusive example 300 of an accessory according to the present disclosure is illustrated in cross-section in FIG. 14. Embodiment 300 includes a body 314 with a base 322 formed from a single piece of material that is folded lengthwise to provide a first layer 340 and a second layer 342. Stitching 344 secures core 326 within body 314, and stitching 346 further secures first and second layers 340, 342 of base 322 together. Though not illustrated, stitching 346 may be provided around the entire periphery of accessory 300, and thereby generally flatten the folded edge of base 322.

Figure 15:
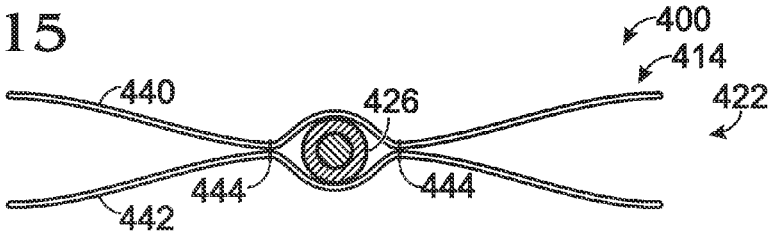
FIG. 15 is a cross-sectional view of yet another embodiment of an accessory according to the present disclosure.

Yet another non-exclusive example 400 of an accessory according to the present disclosure is illustrated in cross-section in FIG. 15. Embodiment 400 includes a body 414 that includes a base 422 formed from two layers 440, 442 that surround a core 426. Stitching 444 is provided about the periphery of core 426 and secures core 426 within body 414. Unlike example 100 illustrated in FIG. 12, the edges of the layers 440, 442 are not stitched together in example 400.

Figure 16:
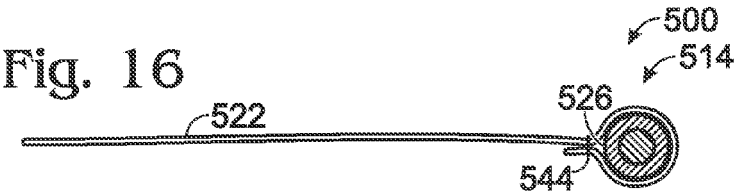
FIG. 16 is a cross-sectional view of yet another embodiment of an accessory according to the present disclosure.

Yet another non-exclusive example 500 of an accessory according to the present disclosure is illustrated in cross-section in FIG. 16. Example 500 includes a body 514 that includes a base 522 formed from only a single strip of material; however, unlike the examples illustrated in FIGS. 11-15, core 526 is secured generally along the edge of the body 514. Stitching 544 is provided to secure core 526 within body 514.

Additionally or alternatively, examples 300, 400, 500 illustrated in FIGS. 14-16, like example 200 illustrated in FIG. 13, may include a separate portion 20 having properties 18 and attached to their respective bases 322, 422, 522.

FIGS. 17-21 schematically illustrate non-exclusive examples of alternative configurations of end regions 50 that may be used for accessories according to the present disclosure. An accessory according to the present disclosure may (though is not required to) incorporate one or more of the illustrated alternative end regions 50 in one or both of the ends of the accessory.

Figure 17:
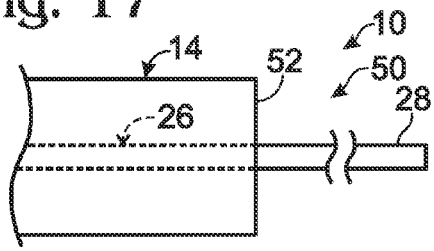
FIG. 17 is a partial plan view of an end region of an accessory according to the present disclosure.

As illustrated in FIG. 17, inner core 26 may extend beyond one or both of the ends 52 of body 14 a predetermined suitable distance. Accordingly, in some uses of an accessory 10, body 14 may be secured around an object and ends 28 of inner core 26 may be twisted about each other without body 14 bunching up thereabout.

Figure 18:
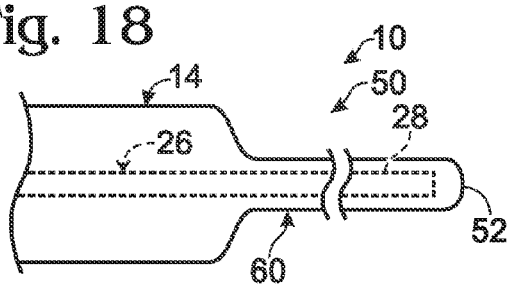
FIG. 18 is a partial plan view of an end region of another embodiment of an accessory according to the present disclosure.

Another non-exclusive example of an alternative end region 50 is illustrated in FIG. 18. In FIG. 18, body 14 includes one or more end regions 60 of reduced width extending a predetermined suitable distance from the end 52 of body 14, through which the end region(s) 28 of inner core 26 extend. In other words, one or both of the end regions 60 of body 14 may have a width less than the remaining portion(s) of body 14. Accordingly, in some uses of an accessory 10, body 14 may be secured around an object and ends 28 of inner core 26 may be twisted about each other without body 14 having to excessively bunch up thereabout. In other words, the end region(s) 60 of body 14 may still bunch up around the twisted portion of inner core 26, but less so than in embodiments not incorporating a reduced width at one or both end regions thereof.

Figure 19:
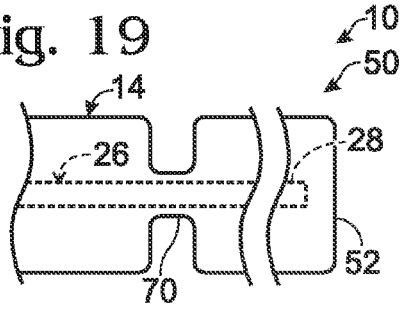
FIG. 19 is a partial plan view of an end region of yet another embodiment of an accessory according to the present disclosure.

Additionally or alternatively, as illustrated in FIG. 19, an end region 50 of an accessory 10 may include a reduced-width section 70 spaced a predetermined suitable distance from an end 52 of body 14. The reduced-width section may be any suitable width and may extend for any suitable length along body 14. Accordingly, in use, the twisting of inner core 26 about itself may take place at the reduced-width section 70 of body 14, thereby avoiding excessive bunching of body 14 there about.

Figure 20:
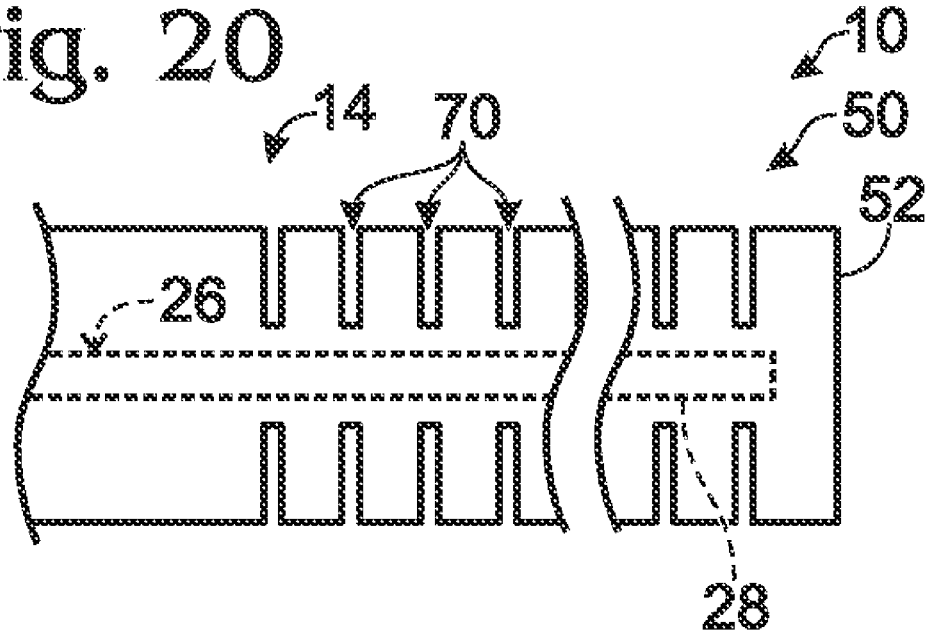
FIG. 20 is a partial plan view of an end region of yet another embodiment of an accessory according to the present disclosure.

Additionally or alternatively, as illustrated in FIG. 20, a plurality of reduced-width sections 70 may be incorporated into an end region a predetermined distance along body 14 from end 52. Accordingly, such embodiments may be secured to various objects of various sizes while still avoiding excessive bunching of body 14 about the twisted end regions of inner core 26. In other words, a single accessory 10 may be configured to be secured to objects of various sizes. For example, to secure an accessory to a smaller object, the twisting of inner core 26 may be implemented at a reduced-width section 70 that is further from the end 52 of body 14 than when securing the accessory to a larger object. That is, to secure the accessory to a larger object, the twisting of inner core 26 may be implemented at a reduced-width section 70 that is closer to the end 52 of body 14. As mentioned, each individual section 70 may extend for any suitable length along body 14. For example, sections 70 may simply be slits in body 14. Additionally, there is no requirement that embodiments including a plurality of sections 70 incorporate sections 70 of uniform width and/or spacing.

Figure 21:
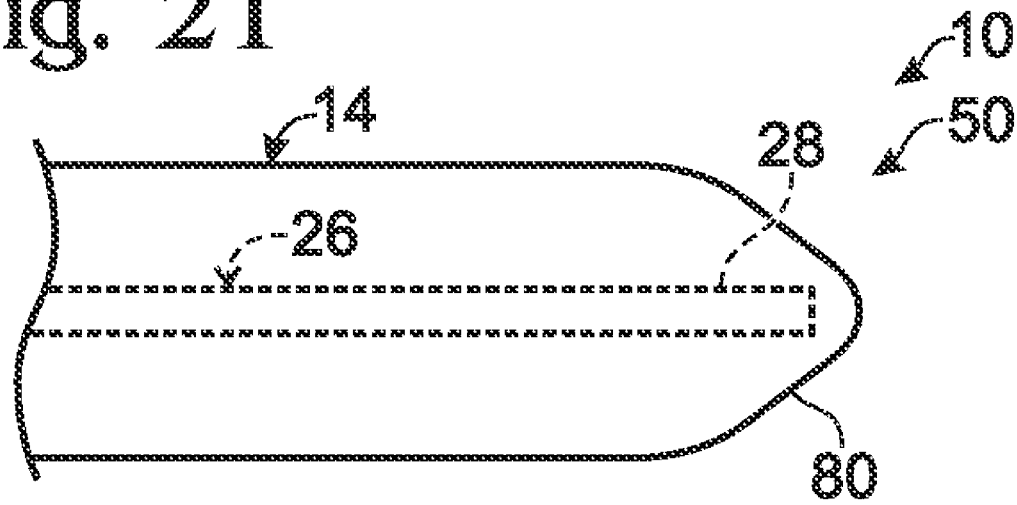
FIG. 21 is a partial plan view of an end region of yet another embodiment of an accessory according to the present disclosure.

Additionally or alternatively, as illustrated in FIG. 21, the end region 50 may include a tapered end region 80 of body 14. Accordingly, in use, the tapered end region 80 may aid in the feeding, or threading, of the accessory about an object, to which it is to be secured.

As mentioned, accessories according to the present disclosure may be used for a variety of applications including, but not limited to, increasing the visibility of a person—or an object associated with a person—engaging in a night-time (or other low-light environment) activity such as walking, hiking, cycling, etc. Accordingly, a non-exclusive example of a method of using an accessory according to the present disclosure may be described as looping the body 14 of an accessory 10 around an object associated with a person and twisting the ends 28 of the inner core 26 about each other to form an enclosed loop around the object and thereby securing the accessory to the object.

The disclosure set forth above encompasses multiple distinct inventions with independent utility. While each of these inventions has been disclosed in a preferred form or method, the specific alternatives, embodiments, and/or methods thereof as disclosed and illustrated herein are not to be considered in a limiting sense, as numerous variations are possible. The present disclosure includes all novel and non-obvious combinations and subcombinations of the various elements, features, functions, properties, methods and/or steps disclosed herein. Similarly, where any disclosure above or claim below recites "a" or "a first" element, step of a method, or the equivalent thereof, such disclosure or claim should be understood to include one or more such elements or steps, neither requiring nor excluding two or more such elements or steps.

Inventions embodied in various combinations and subcombinations of features, functions, elements, properties, steps and/or methods may be claimed through presentation of new claims in a related application. Such new claims, whether they are directed to a different invention or directed to the same invention, whether different, broader, narrower, or equal in scope to the original claims, are also regarded as included within the subject matter of the present disclosure.

The invention claimed is:

1. A reflective accessory for providing increased visibility of a user engaging in an activity in a low-light environment, the accessory comprising:

a flexible body including an outer surface and generally having a width greater than about ⅜ inches and a length greater than about 3 inches; and a mechanism supported by the flexible body, the mechanism configured for attachment of the accessory to an object by looping the accessory around at least a portion of the object and twisting the mechanism about itself to secure the accessory to the object;

wherein at least a portion of the outer surface is configured to reflect light to a degree that the portion of the outer surface is generally more visible than the object to which the accessory is attached when a light source is directed at the portion of the outer surface and the object.

2. The accessory of claim 1, wherein the width is between about ⅜ of an inch and about 2 inches and the length is between about 3 inches and 14 inches.

3. The accessory of claim 1, wherein the width is greater than about ½ of an inch.

4. The accessory of claim 1, wherein the width is greater than about ¾ of an inch.

5. The accessory of claim 1, wherein the length is greater than about 5 inches.

6. The accessory of claim 1, wherein the length is greater than about 7 inches.

7. The accessory of claim 1, wherein the length is greater than about 10 inches.

8. The accessory of claim 1, wherein at least a portion of the mechanism is housed within the flexible body.

9. The accessory of claim 8, wherein at least a portion of the mechanism is not housed within the flexible body.

10. The accessory of claim 1, wherein the mechanism includes a bendable material configured for repeated twisting and untwisting about itself.

11. The accessory of claim 10, wherein the mechanism includes a wire.

12. The accessory of claim 10, wherein the mechanism includes a wire with a non-metal external sheath.

13. The accessory of claim 1, wherein the portion of the outer surface configured to reflect light is retroreflective.

14. The accessory of claim 1, wherein the flexible body includes a first layer and a second layer, and wherein at least a portion of the mechanism is sandwiched between the first and second layers.

15. The accessory of claim 14, wherein the first and second layers are stitched together about at least a portion of a periphery of the mechanism.

16. The accessory of claim 1, wherein the flexible body includes fabric.

17. A method of providing increased visibility of a person engaging in an activity in a low-light environment, the method comprising:

providing the reflective accessory of claim 1;

looping the accessory around at least a portion of the object associated with the person; and twisting the mechanism about itself to form an enclosed loop around the object and thereby securing the accessory to the object.

18. A reflector for use by a person engaging in a low-light activity, the reflector comprising:

a flexible body with at least a portion constructed of a fabric, the flexible body including an outer surface; and a mechanism supported by the flexible body, the mechanism configured to attach the reflector to an object associated with the person by looping the reflector around at least a portion of the object and twisting the mechanism about itself to thereby secure the reflector to the object;

wherein at least a portion of the outer surface is configured to reflect light to a degree that the portion of the outer surface is generally more visible than the object to which the reflector is attached when a light source is directed at the portion of the outer surface and the object.

19. The reflector of claim 18, wherein the flexible body includes a portion with a width greater than about ⅜ of an inch, and the flexible body has a length greater than about 3 inches.

20. The reflector of claim 19, wherein the width is between about ⅜ of an inch and about 2 inches and the length is between about 3 inches and 14 inches.

21. The reflector of claim 18, wherein the flexible body includes a first layer and a second layer;

wherein the mechanism includes a bendable core, at least a portion of the bendable core sandwiched between the first and second layers; and wherein the first and second layers are stitched together about at least a portion of a periphery of the bendable core.

22. A safety device for a user engaging in a low-light activity, the device comprising:

an outer sheath at least partially constructed of a fabric and including a reflective portion; and an inner bendable core at least partially housed within the outer sheath, the inner bendable core configured to enable wrapping the device about an object associated with the user and further configured for being twisted about itself to secure the device to the object.

23. The safety device of claim 22, wherein the sheath includes a first layer and a second layer secured together by stitching provided directly adjacent at least a portion of a periphery of the inner bendable core.

24. The safety device of claim 23, wherein the first and second layers are further secured together by additional stitching provided around a periphery of the sheath.

25. The safety device of claim 22, wherein the sheath includes a first layer stitched to a second layer to define an internal volume therebetween, and wherein the inner bendable core is secured within the internal volume by the stitching.

26. A method of providing increased visibility of a person engaging in an activity in a low-light environment, the method comprising:

providing a reflective accessory, the reflective accessory comprising:

a flexible body including an outer surface with high reflectivity; and a bendable core supported by the flexible body, the bendable core including ends;

looping the flexible body around an object associated with the person; and twisting the ends of the bendable core about each other to form an enclosed loop around the object and thereby securing the accessory to the object.

27. A plurality of reflective accessories for providing increased visibility of users engaging in activities in low-light environments, each accessory comprising:

a flexible body including an outer surface and generally having a width and a length; and a mechanism supported by the flexible body, the mechanism configured for attachment of the accessory to an object associated with a user by looping the accessory around at least a portion of the object and twisting the mechanism about itself to secure the accessory to the object;

wherein at least a portion of the outer surface is configured to reflect light to a degree that the portion of the outer surface is generally more visible than the object to which the accessory is attached when a light source is directed at the portion of the outer surface and the object; and wherein at least a one of the plurality of accessories has a flexible body with a first length and at least another one of the plurality of accessories has a flexible body with a second length greater than the first length.

* * * * *